US010825619B2

(12) United States Patent
Wu et al.

(10) Patent No.: US 10,825,619 B2
(45) Date of Patent: Nov. 3, 2020

(54) RESILIENT BODY AND KEYBOARD STRUCTURE

(71) Applicant: CHICONY ELECTRONICS CO., LTD., New Taipei (TW)

(72) Inventors: Fei-Wu Wu, New Taipei (TW); Tsung-Min Chen, New Taipei (TW); Liang-Yuan Yang, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 16/573,428

(22) Filed: Sep. 17, 2019

(65) Prior Publication Data

US 2020/0294738 A1 Sep. 17, 2020

(30) Foreign Application Priority Data

Mar. 12, 2019 (CN) ..... 2019 1 0191025

(51) Int. Cl.
*H01H 13/7065* (2006.01)
*H01H 13/85* (2006.01)

(52) U.S. Cl.
CPC ..... *H01H 13/7065* (2013.01); *H01H 13/85* (2013.01); *H01H 2217/01* (2013.01); *H01H 2221/05* (2013.01); *H01H 2227/002* (2013.01); *H01H 2227/032* (2013.01)

(58) Field of Classification Search
CPC .. H01H 13/7065; H01H 13/705; H01H 13/14; H01H 13/023; H01H 23/14; H01H 23/28; H01H 23/20; H01H 21/12; H01H 21/282; H01H 21/285; H01H 13/10; H01H 2221/05; H01H 2217/01; H01H 2227/002; H01H 2227/032; G06F 3/0202
USPC ..... 200/344, 339, 341, 343, 257, 277.1, 329
See application file for complete search history.

(56) References Cited

U.S. PATENT DOCUMENTS 5,967,298 A * 10/1999 Watanabe ..... H01H 3/125 200/344
7,045,722 B2 * 5/2006 Tsai ..... H01H 13/85 200/5 A
7,902,473 B2 * 3/2011 Yeh ..... H01H 13/82 200/341
8,450,626 B2 * 5/2013 Yang ..... H01H 3/125 200/344
8,742,276 B2 * 6/2014 Zhang ..... H01H 3/125 200/314

(Continued)

FOREIGN PATENT DOCUMENTS

CN 103681056 A 3/2014
TW 201837940 A 10/2018

*Primary Examiner* — William A Bolton
(74) *Attorney, Agent, or Firm* — Muncy, Geissler, Olds & Lowe, P.C.

(57) ABSTRACT

A resilient body and a keyboard structure are disclosed. The resilient body has a top portion, a bottom portion, a conducting post and an annular wall. The top portion has a first side wall and a first bottom surface. Before the resilient body is pressed, an angle is formed between the first side wall and the first bottom surface, wherein the angle is greater than 90°. The bottom portion has a second bottom surface. The conducting post is disposed under the first bottom surface. When the resilient body is pressed, the fire point of the resilient body is reached before the resilient body reaches the bottom point.

17 Claims, 4 Drawing Sheets

(56) References Cited

U.S. PATENT DOCUMENTS

| | | | | |
|---|---|---|---|---|
| 8,779,308 | B2 * | 7/2014 | Takemae | H01H 13/702 200/5 A |
| 2011/0056817 | A1 * | 3/2011 | Wu | H01H 13/14 200/344 |
| 2014/0339065 | A1 * | 11/2014 | Ohtsuka | H01H 3/125 200/5 A |
| 2017/0213663 | A1 * | 7/2017 | Jhuang | H01H 3/125 |
| 2018/0182575 | A1 * | 6/2018 | Chiu | H01H 13/85 |
| 2018/0286604 | A1 | 10/2018 | Okutani | |

* cited by examiner

RESILIENT BODY AND KEYBOARD STRUCTURE

BACKGROUND OF THE INVENTION

1. Field of the Invention

The present invention relates to a resilient body and a keyboard structure, particularly to a resilient body and a keyboard structure wherein when the total moving stroke of the resilient body is unchanged, a fire point of the resilient body is reached before the resilient body reaches a bottom point to create a comfortable tapping feel for users.

2. Description of the Related Art

With the advancement of technology, desktop and notebook computers have become indispensable devices, and people use computers for long periods of time, whether at work or at leisure. The main input devices for desktop or notebook computers are physical keyboards. If the user feels that the keyboard is not sensitive enough due to a poor tapping feeling, the user intuitively exerts a greater tapping force to ensure that the keyboard input will keep up with the system receiving the input. In this case, if such a keyboard is used for a long time, it is easy for the user's fingers to become fatigued. Therefore, it is necessary to provide a resilient body with a comfortable tapping feel and a keyboard with a resilient body to solve the problems in the prior art.

SUMMARY OF THE INVENTION

It is a primary objective of the present invention to provide a resilient body wherein when the total moving stroke of the resilient body is unchanged, a fire point of the resilient body is reached before the resilient body reaches a bottom point to create a comfortable tapping feel for users.

It is another objective of the present invention to provide a keyboard structure wherein when the total moving stroke of the resilient body is unchanged, a fire point of the resilient body is reached before the resilient body reaches a bottom point to create a comfortable tapping feel for users.

To achieve the above objectives, a resilient body of the present invention includes a top portion, a bottom portion, a conducting post, and an annular wall. The top portion has a first side wall and a first bottom surface. Before the resilient body is pressed, an angle is formed between the first side wall and the first bottom surface, wherein the angle is greater than 90°. The bottom portion has a second bottom surface. The conducting post is disposed under the first bottom surface. The two ends of the annular wall are respectively connected to the top portion and the bottom portion. By this design, when the resilient body is pressed, the fire point of the resilient body is reached before the resilient body reaches the bottom point.

The present invention further provides a keyboard structure, which includes a keycap, the aforementioned resilient body, and a bottom plate. Specifically, the resilient body is disposed between the keycap and the bottom plate.

The present invention further provides a resilient body used for a keyboard structure. The keyboard structure includes a keycap and a bottom plate. The bottom plate includes a membrane switch. The resilient body is disposed between the keycap and the bottom plate. Further, the resilient body includes a top portion, a bottom portion, a conducting post and an annular wall. The top portion includes a first side wall and a first bottom surface. Before the resilient body is pressed, an angle is formed between the first side wall and the first bottom surface, wherein the angle is greater than 90°. The bottom portion has a second bottom surface. The conducting post is disposed under the first bottom surface. Two ends of the annular wall are respectively connected to the top portion and the bottom portion. Thereby, when the resilient body is pressed, the conducting post triggers the membrane switch before the first bottom surface and the keycap contact each other.

Through the features of the resilient body and the keyboard structure in the present invention, wherein the angle between the first side wall and the first bottom surface are limited to be greater than 90° and the structural design of the conduction stroke is such that when the total moving stroke of the resilient body is unchanged, a fire point of an input signal is reached before the resilient body reaches the bottom point, a sensitive and comfortable tapping feel is provided for users.

DETAILED DESCRIPTION OF THE PREFERRED EMBODIMENT

Hereafter, the technical content of the present invention will be better understood with reference to preferred embodiments. Please refer to FIG. 1 to FIG. 4 for a perspective view of a resilient body in an embodiment of the present invention, a cross-sectional view of a keyboard structure in an embodiment of the present invention, a cross-sectional view showing the resilient body deformed by an external force, and a curve chart showing the external force stroke of the resilient body according to an embodiment of the present invention.

Figure 1:
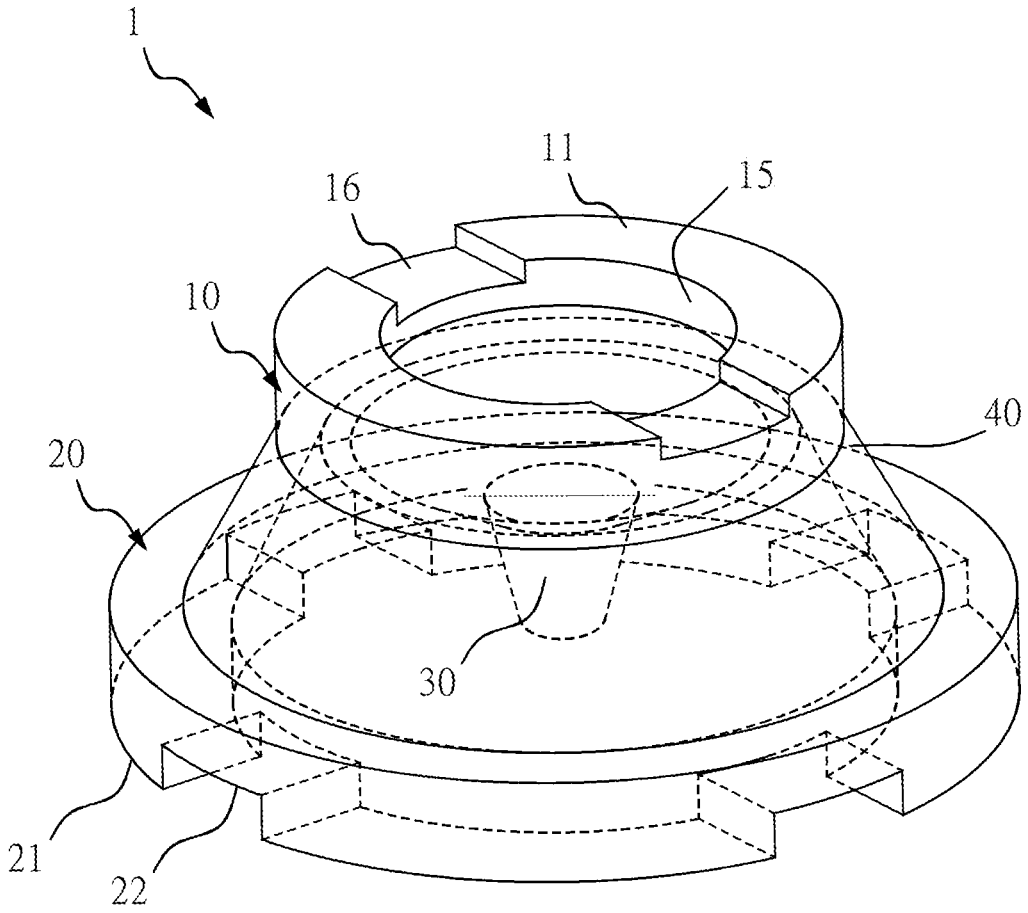
FIG. 1 is a perspective view of a resilient body in an embodiment of the present invention.
Figure 2:
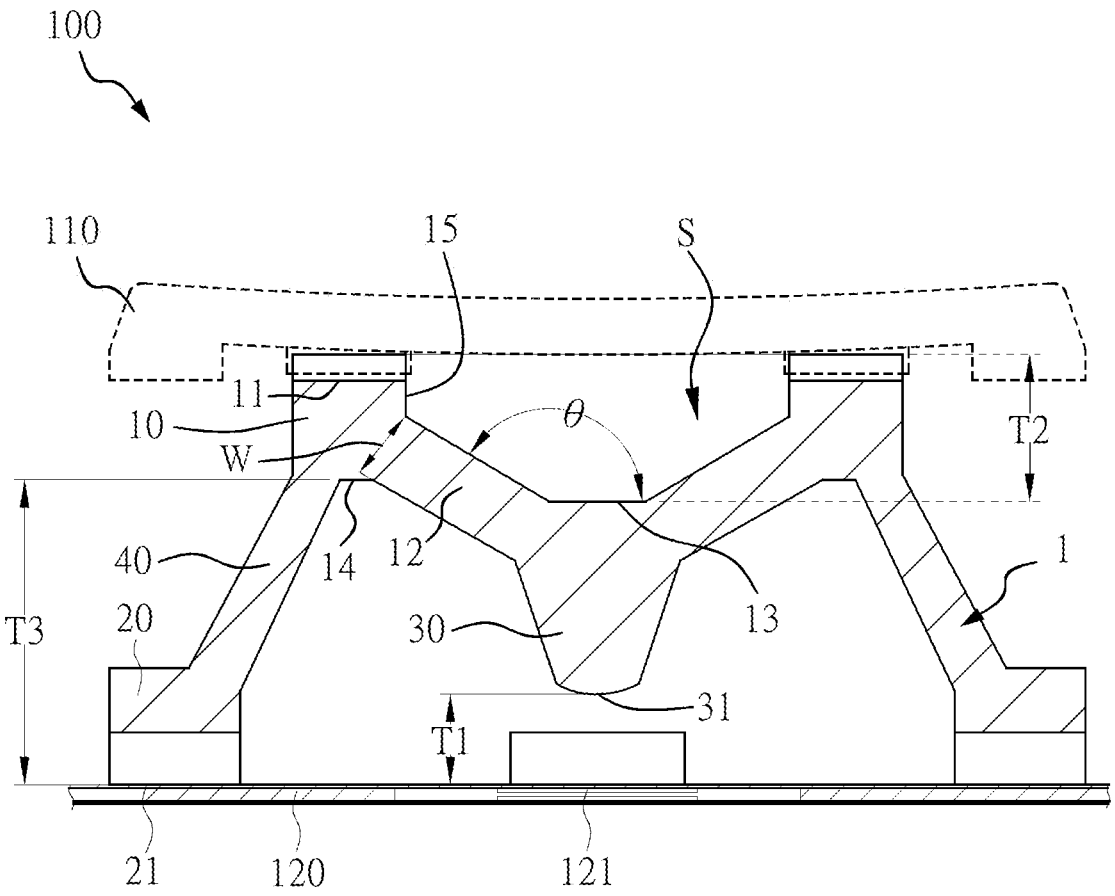
FIG. 2 is a cross-sectional view of a keyboard structure in an embodiment of the present invention.

As shown in FIG. 1 and FIG. 2, according to an embodiment of the present invention, a keyboard structure 100 in the present invention includes a keycap 110, a resilient body 1 and a bottom plate 120. Specifically, the resilient body 1 is disposed between the keycap 110 and the bottom plate 120, and the bottom plate 120 includes at least one membrane switch 121. In this embodiment, as shown in FIG. 1 and FIG. 2, the resilient body 1 includes a top portion 10, a bottom portion 20, a conducting post 30, and an annular wall 40. Specifically, the annular wall 40 is connected to the top portion 10 and the bottom portion 20, and the conducting post 30 is disposed under the top portion 10.

Before the resilient body 1 is pressed, the top portion 10 is bowl-shaped, having a side wall formed with an angle. Specifically, the top portion 10 has a top surface 11, a first side wall 12, a first bottom surface 13, a joint surface 14, and a second side wall 15. A recessed space S is formed by the top surface 11, the first side wall 12, the first bottom surface 13 and the second side wall 15. Specifically, the first bottom surface 13 is connected to the first side wall 12, and the top surface 11 is connected to the second side wall 15. The two ends of the joint surface 14 are respectively connected to the first side wall 12 and the annular wall 40. The end of the annular wall 40 not connected to the joint surface 14 is connected to the bottom portion 20.

Figure 3:
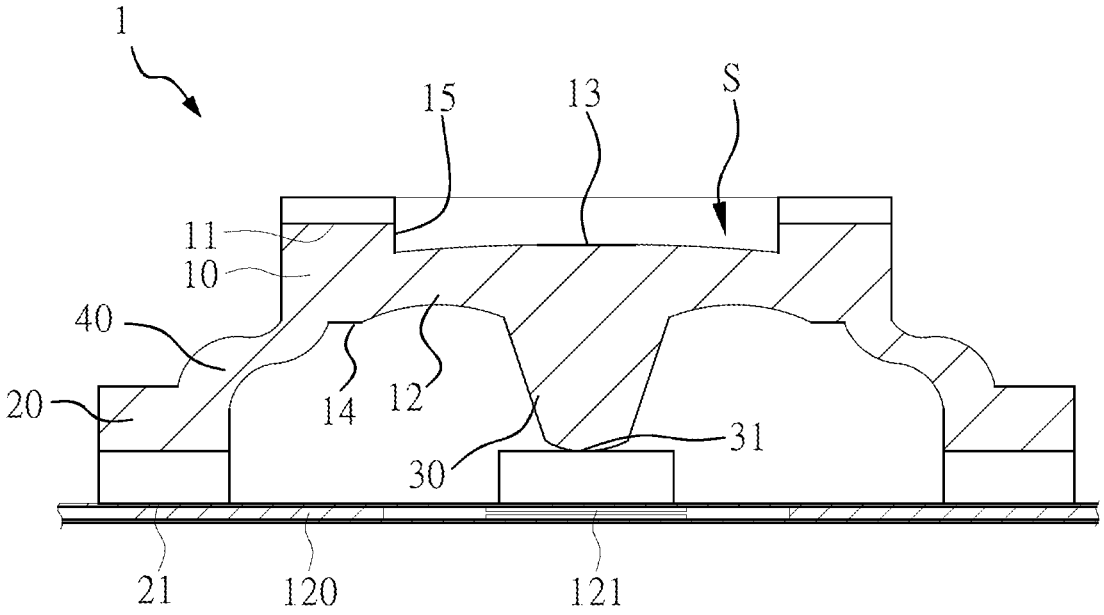
FIG. 3 is a cross-sectional view showing the resilient body deformed by an external force according to an embodiment of the present invention.

Before the resilient body 1 is pressed, an angle θ is formed between the first side wall 12 and the first bottom surface 13, wherein the angle θ is greater than 90°. As shown in FIG. 2 and FIG. 3, through the design that the angle θ is greater than 90°, when the resilient body 1 is pressed, the feature of the angle θ between the first side wall 12 and the first bottom surface 13 being greater than 90° can provide more buffer space for the conducting post 30, whereby the resilient body 1 reaches bottom point of the resilient body 1 late. According to an embodiment of the present invention, the angle θ ranges from 100° to 170°, but the present invention is not limited to this range. Additionally, in the present embodiment, the thickness of the first side wall 12 ranges from 0.3 mm to 0.5 mm, and the resistance of the deformation of the resilient body 1 is reduced due to the feature of the thickness of the first side wall 12, thereby creating a light and sensitive tapping feel for users. Further, due to the feature of the thickness of the first side wall 12, the resilient body 1 of the present invention has a turn point (point P1*a*) before the fire point P2, which is further illustrated in a later paragraph in conjunction with FIG. 4.

As shown in FIG. 1 and FIG. 2, the top surface 11 is a side of the resilient body 1 adjacent to the keycap 110. Specifically, a first stroke T2 is formed between the top surface 11 and the first bottom surface 13, and the first stroke T2 is the depth of the recessed space S of the top portion 10. According to an embodiment of the present invention, the first stroke T2 ranges from 0.5 mm to 1 mm, but the present invention is not limited to this range.

As shown in FIG. 1 and FIG. 2, the bottom portion 20 has a second bottom surface 21. Specifically, the second bottom surface 21 is the lowest point of the resilient body 1, and the second bottom surface 21 is a side of the resilient body 1 adjacent to the bottom plate 120. A total stroke T3 is formed between the second bottom surface 21 and the joint surface 14.

As shown in FIG. 1 and FIG. 2, the conducting post 30 is disposed under the first bottom surface 13, and the conducting post 30 and the centerline of the first bottom surface 13 overlap. When the user taps the keycap 110 to press the resilient body 1, the conducting post 30 abuts the membrane switch 121 to generate a corresponding input signal. The conducting post 30 of the present invention is conical. The conducting post 30 has a bottom surface 31. A conduction stroke T1 is formed between the second bottom surface 21 and the bottom surface 31. According to an embodiment of the present invention, the total stroke T3 ranges from 1 mm to 3 mm, and the conduction stroke T1 is less than 0.6 mm. According to an embodiment of the present invention, the total stroke T3 ranges from 1.5 mm to 3 mm, and the conduction stroke T1 is less than 1.5 mm. Accordingly, the resonant body 1 can reach the fire point early such that the user can feel the prompt and early input of the message.

According to an embodiment of the present invention, the height of the resilient body 1 ranges from 1.5 mm to 4 mm. According to an embodiment of the present invention, the height of the bottom portion ranges from 0.4 mm to 0.8 mm.

According to an embodiment of the present invention, the outer diameter of the top portion 10 ranges from 2 mm to 4.5 mm, and the inner diameter of the top portion 10 ranges from 1.5 mm to 3.5 mm. According to an embodiment of the present invention, the outer diameter of the bottom portion 20 ranges from 3.5 mm to 8 mm, and the inner diameter of the bottom portion 20 ranges from 2 mm to 7 mm.

In addition, due to the conical design of the conducting post 30, when the user taps the corner of the keycap 110, even if the pressed conducting post 30 is angularly displaced downward, it can ensure a sufficient contact area and trigger force between the pressed conducting post 30 and the membrane switch 121 to generate an input signal for the resilient body 1 of the present invention to achieve key-in stability. Furthermore, due to the design that the top portion 10 is bowl-shaped, having an angle between side walls, it is ensured that the top portion 10 is not easily offset when the resilient body 1 is pressed down, such that the resilient body 1 of the present invention can provide a key-in stabilizing effect.

According to an embodiment of the present invention, the diameter of the conducting post 30 ranges from 0.5 mm to 2.5 mm. According to an embodiment of the present invention, the diameter of the top of the conical conducting post 30 ranges from 0.5 mm to 3 mm, and the diameter of the bottom surface 31 of the conical conducting post 30 ranges from 0.3 mm to 2.5 mm.

Furthermore, in order for the resilient body 1 of the present invention to better achieve the effect of the fire point being reached before the bottom point, besides the features of the angle θ being greater than 90° and the conduction stroke T1, the resilient body 1 further satisfies the structural feature of that the stroke T1+the first stroke T2<the total stroke T3 (the sum of the stroke T1 and the first stroke T2 is less than the total stroke T3).

According to an embodiment of the present invention, as shown in FIG. 1, the top portion 10 includes at least one first exhaust hole 16. The first exhaust hole 16 is provided on the top surface 11. The bottom portion 20 includes at least one second exhaust hole 22. The second exhaust hole 22 is provided on the second bottom surface 21. It should be noted that in the present embodiment, the number of the first exhaust holes 16 is two and the number of the second exhaust holes 22 is four. However, the present invention does not specifically limit the number of the first exhaust holes 16 and the second exhaust holes 22, and the first exhaust holes 16 and the second exhaust holes 22 can achieve the exhaust function. When the user taps the keyboard structure 100, the first exhaust holes 16 and the second exhaust holes 22 can reduce the noise generated by the resilient body 1.

Figure 4:
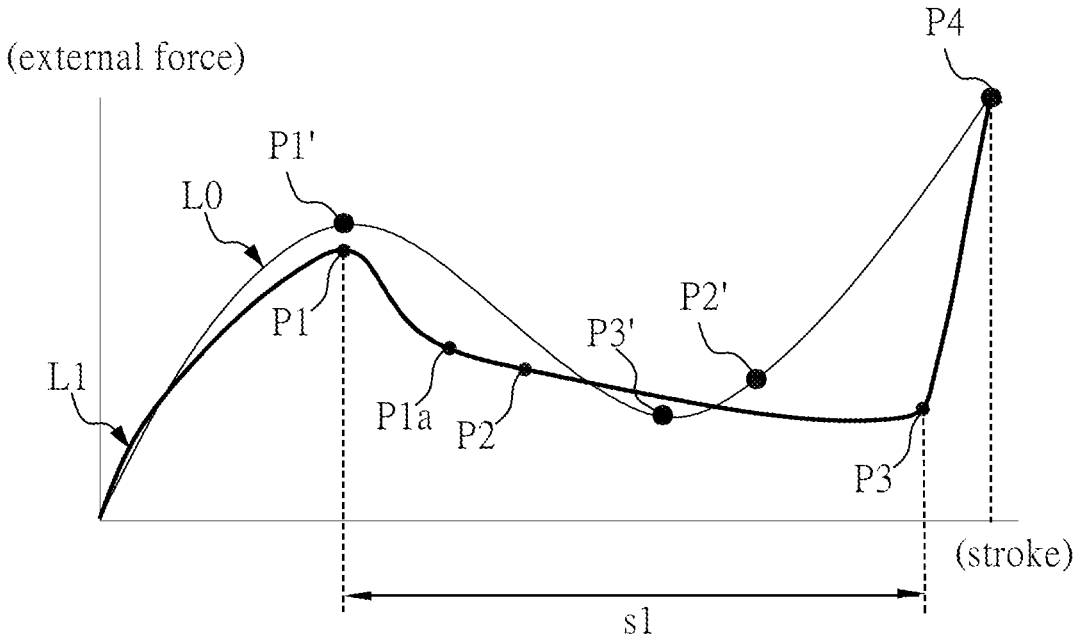
FIG. 4 is a curve chart showing the external force stroke of the resilient body according to an embodiment of the present invention.

Please refer to FIG. 4 for the effect difference between the resilient body 1 of the present invention and the resilient body in the prior art. FIG. 4 is used to illustrate the relationship between the external force (downward thrust) applied to the resilient body 1 by pressing the keycap 110 and the pressing stroke (downward distance). As shown in FIG. 2 to FIG. 4, when the resilient body 1 of the present invention starts to be pressed, as the applied force increases, the keycap 110, the top portion 10 of the resilient body 1 and the conducting post 30 gradually move downward (toward the membrane switch 121). Due to the limitation of the elasticity of the resilient body 1 and the internal space of the keyboard, the first side wall 12 and the annular wall 40 are deformed by the force. When the external force is released, the resilient body 1 is restored to the state shown in FIG. 2 by the elastic restoring force of the resilient body 1.

As shown in FIG. 4, a curve L0 is an external force stroke curve of the resilient body in the prior art, and the curve L0 is formed by point P1', point P2', point P3' and point P4; a curve L1 is the external force stroke curve of the resilient body 1 in the present invention, and the curve L1 is formed by point P1, point P1*a*, point P2, point P3 and point P4. As shown in FIG. 4, the curve L0 and the curve L1 have the same external force ending point P4. That is, the total strokes of the resilient body in the prior art and the resilient body 1 are the same. The point P1' and the point P1 are the peak points of the external force stroke curves. The point P2' and the point P2 are fire points (fire/contact points), commonly known as the key-in points, at which the membrane switch is triggered. The points P3' and P3 are bottom points, at which the resilient bodies are very close to the bottom plates. The bottom points are also the lowest points of the downward movement of the pressed resilient bodies. At the bottom points, the external force is the minimum, and the bottom points are also the troughs in the external force stroke curves. The point P4 is the end point of the external force stroke. In addition, the resilient body 1 of the present invention has a turn point (P1*a*) before the fire point P2. The turn point (P1*a*) is a unique design of the present invention, and the resilient body in the prior art does not have turn point. The details of the points P1, P1*a*, P2, P3 and P4 in the curve L1 of the resilient body 1 according to the present invention will be further described hereinafter.

As shown in FIG. 4, at P1' and P1, the resilient body in the prior art and the resilient body 1 are subjected to the maximum downward force. When the pressing stroke of the resilient body 1 in the present invention passes through the peak point P1, the side wall 40 starts to bend (as shown in FIG. 3). When the pressing stroke passes through the turn point P1*a*, the top portion 10 starts to bend. When the pressing stroke reaches the bottom point P3, the first bottom surface 13 of the top portion contacts the bottom surface of the keycap 110. As shown in FIG. 4, the total stroke of the resilient body 1 in the present invention is the same as the total stroke of the resilient body in the prior art. The stroke s of the resilient body 1 from the peak point P1 to the bottom point P3 is significantly larger than the stroke of the resilient body in the prior art from the peak point P1' to the bottom point P3'. The bottom point P3 of the resilient body 1 is reached later, such that the stroke s1 from the peak point P to the bottom point P3 is elongated, thereby shortening the pressing stroke from the bottom point P3 to the end point P4. The external force applied during the stroke from the bottom point P3 to the external force end point P4 is rapidly increased with the increase of the stroke. That is, the user will experience a laborious pressing feel after the bottom point P3. The resilient body 1 in the present invention shortens the stroke distance from the bottom point P3 to the end point of the external force stroke P4, thereby shortening the experience of the laborious feel and allowing the user to experience the comfort of tapping. In the design of the resilient body in the prior art, when the user presses the keycap, then after a first increase of the applied force (referring to the section of the curve L0 from the start of the pressing stroke to the peak point P1' shown in FIG. 4), a second increase of the applied force is required (referring to the section of the curve L0 from the bottom point P3' to the end of stroke P4 shown in FIG. 4). The resilient body 1 of the present invention has a long pressing stroke that provides an effortless tapping feel (i.e., the force is reduced with an increase in the stroke) after a first increase of the applied force (referring to the section of the curve L1 from the start of the pressing stroke to the peak point P1). This allows the user to feel that pressing effect of the first applied force can last longer.

In addition, the pressing stroke of the resilient body 1 in the present invention has a turn point P1*a* before the fire point P2. At the turn point P1*a*, the first side wall 12 of the resilient body 1 begins to deform. Due to the angle θ between the first side wall 12 and the first bottom surface 13, which is greater than 90°, and the design of the thickness of the first side wall 12, a step difference is formed at the external force stroke curve of the resilient body 1 (as shown in the curve L1). Accordingly, the user can experience the step-difference tapping feel. As shown in FIG. 4, from the peak point P1 to the turn point P1*a*, the external force applied is rapidly decreased with the increase of the stroke; from the turn point P1*a* to the fire point P2, the external force applied decreases steadily with the increase of the stroke.

Meanwhile, as show in FIG. 4, the fire point P2 of the resilient body 1 in the present invention is reached before the bottom point P3. That is, when the resilient body 1 is pressed, the conducting post 30 triggers the membrane switch 121 before the first bottom surface 13 contacts the keycap 110. Accordingly, when the conducting post 30 contacts the membrane switch 121, the resilient body 1 of the present invention has not reached the bottom point P3, and there is still space for the first side wall 12 and the annular wall 40 to deform. Due to the angle between the first side wall 12 and the first bottom surface 13, which is greater than 90°, and the design structure of the resilient body 1 such that the sum of the stroke T1 and the first stroke T2 is less than the total stroke T3 (the conduction stroke T1+the first stroke T2<the total stroke T3), when the conducting post 30 contacts the membrane switch 121, the resilient body 1 of the present invention still has buffer space for the resilient body 1 to be pressed downward. After the conducting post 30 contacts the membrane switch 121, the resilient body 1 can continue to be pressed, such that the bottom point P3 is reached late. Compared with the prior art having equivalent total stroke, the keyboard structure with the resilient body 1 in the present invention provides a longer key pressing feel and a faster key-in speed, which conforms to the trend of thin keyboards.

As shown in FIG. 4, the fire point P2 of the resilient body 1 in the present invention is reached significantly earlier than the fire point P2' of the resilient body in the prior art, and the fire point P2' of the resilient body in the prior art is reached later than the bottom point P3'. In other words, when the user taps the keyboard structure with the resilient body in the prior art and the resilient body reaches the bottom point P3', the membrane switch 121 has not triggered, so the user needs to apply a greater tapping force to make the resilient body trigger the membrane switch 121. If this type of keyboard is used for a long time, it will cause finger fatigue. In contrast, the fire point P2 of the resilient body 1 in the present invention is reached before the bottom point P3. That is, when the keyboard structure with the resilient body 1 of the present invention is used, the keyboard structure can be triggered by a slight force, and after the resilient body 1 passes through the fire point P2, the resilient body 1 continues to move downward. Since the downward movement stroke of the resilient body 1 is elongated and the fire point P2 is reached early, the resilient body 1 and the keyboard structure 100 in the present invention produce a sensitive and comfortable tapping effect. Accordingly, the problems in the prior art are solved.

In summary, according to the resilient body 1 and the keyboard structure 100 in the present invention, due to the angle θ between the first side wall 12 and the first bottom surface 13, which is greater than 90°, and the structural features of the conduction stroke, the total moving stroke of the resilient body 1 in the present invention is unchanged, the fire point P2 for keying in signal is reached before the bottom point P3 of the resilient body 1. This provides the user with a sensitive and comfortable tapping feel.

It should be noted that the embodiments of the present invention described above are only illustrative. It is intended that the present invention cover modifications and variations of the invention provided they fall within the scope of the following claims and their equivalents. Therefore, it will be apparent to those skilled in the art that various modifications and variations can be made to the structure of the present invention without departing from the scope or spirit of the invention as defined solely by the appended claims.

What is claimed is:

1. A resilient body, used for a keyboard structure, the resilient body comprising:

a top portion, having a first side wall and a first bottom surface, wherein before the resilient body is pressed, an angle is formed between the first side wall and the first bottom surface, wherein the angle θ is greater than 90°;

a bottom portion, having a second bottom surface;

a conducting post, disposed under the first bottom surface; and an annular wall, two ends of which are connected to the top portion and the bottom portion, respectively;

wherein when the resilient body is pressed, a fire point of the resilient body is reached before the resilient body reaches a bottom point, wherein the conducting post has a bottom surface, a conduction stroke T1 is formed between the second bottom surface and the bottom surface of the conducting post, the top portion comprises a top surface and a joint surface, a first stroke T2 is formed between the top surface and the first bottom surface, and a total stroke T3 is formed between the second bottom surface and the joint surface, wherein T1+T2<T3.

2. The resilient body as claimed in claim 1, wherein the two ends of the joint surface are respectively connected to the first side wall and the annular wall, and an end of the annular wall not connected to the joint surface is connected to the bottom portion.

3. The resilient body as claimed in claim 1, wherein the conducting post is conical.

4. The resilient body as claimed in claim 1, wherein the top portion comprises at least one first exhaust hole disposed on the top surface and the bottom portion comprises at least one second exhaust hole disposed on the second bottom surface.

5. A keyboard structure, comprising:

a keycap;

a bottom plate; and the resilient body as claimed in claim 1, wherein the resilient body is disposed between the keycap and the bottom plate.

6. The keyboard structure as claimed in claim 5, wherein the conduction stroke T1 is less than 0.6 mm.

7. The keyboard structure as claimed in claim 5, wherein the conduction stroke T1 is less than 1.5 mm.

8. The keyboard structure as claimed in claim 5, wherein the first stroke T2 ranges from 0.5 mm to 1 mm, and the total stroke T3 ranges from 1.5 mm to 3 mm.

9. The keyboard structure as claimed in claim 5, wherein the first stroke T2 ranges from 0.5 mm to 1 mm, and the total stroke T3 ranges from 1 mm to 3 mm.

10. The keyboard structure as claimed in claim 5, wherein the angle θ ranges from 100° to 170°.

11. The keyboard structure as claimed in claim 5, wherein a thickness of the first side wall ranges from 0.2 mm to 0.8 mm.

12. The keyboard structure as claimed in claim 5, wherein a thickness of the first side wall ranges from 0.3 mm to 0.5 mm.

13. The keyboard structure as claimed in claim 5, wherein the conducting post is conical.

14. The keyboard structure as claimed in claim 5, wherein a diameter of the conducting post ranges from 0.5 mm to 2.5 mm.

15. The keyboard structure as claimed in claim 5, wherein the top portion comprises at least one first exhaust hole disposed on the top surface.

16. The keyboard structure as claimed in claim 5, wherein the bottom portion comprises at least one second exhaust hole disposed on the second bottom surface.

17. A resilient body, used for a keyboard structure comprising a keycap and a bottom plate, the bottom plate having a membrane switch, the resilient body being disposed between the keycap and the bottom plate, the resilient body comprising:

a top portion, having a first side wall and a first bottom surface, wherein before the resilient body is pressed, an angle is formed between the first side wall and the first bottom surface, where the angle is greater than 90°;

a bottom portion, having a second bottom surface;

a conducting post, disposed under the first bottom surface; and an annular wall, two ends of which are connected to the top portion and the bottom portion, respectively;

wherein when the resilient body is pressed, the conducting post triggers the membrane switch before the first bottom surface and the keycap contact each other, and wherein the conducting post has a bottom surface, a conduction stroke T1 is formed between the second bottom surface and the bottom surface of the conducting post, the top portion comprises a top surface and a joint surface, a first stroke T2 is formed between the top surface and the first bottom surface, and a total stroke T3 is formed between the second bottom surface and the joint surface, wherein T1+T2<T3.

* * * * *